US005362086A

United States Patent [19]

Baron et al.

[11] Patent Number: 5,362,086

[45] Date of Patent: Nov. 8, 1994

[54] ALPINE SKI BINDING

[75] Inventors: Pascal Baron, Seynod; Pierre Desarmaux, Evires, both of France

[73] Assignee: Salomon S.A., Courbevoie, France

[21] Appl. No.: 82,481

[22] Filed: Jun. 28, 1993

[30] Foreign Application Priority Data

Jun. 30, 1992 [FR] France ..... 92 08334

[51] Int. Cl.[5] ..... A63C 7/10

[52] U.S. Cl. ..... 280/605

[58] Field of Search ..... 280/605, 604, 601, 607, 280/617, 618

[56] References Cited

U.S. PATENT DOCUMENTS

| | | | |
|---|---|---|---|
| 4,138,137 | 2/1979 | Beyl | 280/605 |
| 4,729,577 | 3/1988 | Gasquet et al. | 280/605 |
| 5,002,303 | 3/1991 | Freisinger et al. | 280/605 |

FOREIGN PATENT DOCUMENTS

| | | |
|---|---|---|
| 0159203 | 10/1985 | European Pat. Off. . |
| 7527776 | 9/1975 | Germany . |
| 9108807 | 6/1991 | WIPO . |

*Primary Examiner*—Kenneth R. Rice
*Assistant Examiner*—Michael Mar
*Attorney, Agent, or Firm*—Pollock, Vande Sande & Priddy

[57] ABSTRACT

Alpine ski binding (1) comprising a base plate (2), to which a boot position-retention element (3) and a ski brake (8) are assembled. The base plate (2) is designed to be integrally attached to the ski using screws (14, 15). The ski brake incorporates a seating (10) superposed to the base plate (2), and the base is assembled to the base plate through the cooperation of tenons (18, 19) and mortises (20, 21) in the base plate (2). The brake (8) is, moreover, assembled to the base plate (2) by a movable locking device (23). The front screws used to assemble the binding to the ski pass through both the seating (10) of the brake (8) and the front part of the base plate (2), and their heads rest on the base plate (10) of the brake. The binding is delivered with the brake assembled, and, subsequently, dismantling the brake is possible by loosening the front screws (14) and by opening the locking device (23).

5 Claims, 3 Drawing Sheets

ALPINE SKI BINDING

FIELD OF THE INVENTION

The invention concerns an almine ski binding. More specifically, the invention relates to an alpine ski binding comprising a generally elongated base plate, to which a boot position-retention element and a ski brake are assembled.

BACKGROUND

A boot is conventionally supported on an alpine ski by means of a front and a rear binding. The ski brake equipping virtually all ski bindings is most frequently associated with the rear binding.

The rear binding comprises a body which, mounted on the base plate, carries a boot position-retention mechanism.

The base plate is integrally attached by means of screws which press it down and hold it against the upper surface of the ski.

In conventional fashion, the ski brake connected to the binding comprises at least one brake arm which is movable in relation to a seating fastened to the ski between an operative, braking position, and an inoperative, resting position.

In some prior art bindings, the brake seating is incorporated into the base plate of the binding. In these bindings, the brake is mounted on the ski together with the base plate, thereby saving mounting time. In fact, the entire binding-mounting operation is carried out in a single step. However, if, following the occurrence of a technical problem, replacement of the brake is desired, the entire binding must be dismantled, and the brake and the base plate of the binding must be changed at the same time.

In other existing bindings, the brake seating is distinct from the base plate of the binding. In this case, the base plate is first assembled to the ski with the body of the binding, then the brake is mounted by its seating on the base plate belonging to the binding. When a technical problem occurs in the brake, the latter can be replaced. However, mounting the binding on the ski requires an additional operation , i.e., assembly of the brake to the base plate of the binding.

In the case of these bindings, it must be noted that the brake is connected to the rest of the binding, and thus to the ski, only by movable mounting means, thus allowing the brake to be easily dismantled. In other words, the screws used for attachment to the base plate on the ski perform no function as regards the assembly of the brake to the rest of the binding. This assembly is, nevertheless, subjected to pronounced stresses when the brake is actuated. Accordingly, means of assembly of the brake to the base plate providing a very high level of resistance are required.

SUMMARY OF THE INVENTION

One of the objects of the invention is to propose a binding which can be mounted very rapidly on the ski in a single operation.

The invention is also intended to propose a binding whose brake can be dismantled simply from the base plate of the binding.

A further object of the invention is to propose a binding whose screws allowing attachment of the base plate to the ski also exert an action on the mounting of the brake seating on the base plate.

Other objects and advantages of the invention will emerge during the following description, which is provided, however, solely for informational purposes and is not restrictive.

The alpine ski binding comprises a generally elongated base plate, to which a boot position-retention element and a ski brake are assembled, the base plate being designed to be attached to the ski using screws which press it down against the upper surface of the ski, the position-retention element comprising a body assembled to the base plate over at least a portion of its length, and a boot position-retention device carried by the body, the brake comprising a seating superposed on the base plate over a portion of its length and being assembled to the base plate, and at least one brake arm connected to the seating and being movable in relation to the latter between an inactive, resting position and an active working position, the brake seating and the base plate of the binding incorporating superposed holes designed to receive at least a portion of the screws integrally fastening the plate to the ski, so that these screws tighten the base plate and the brake seating against the ski.

The alpine ski binding is characterized by the fact that means used to assemble the brake seating to the base plate of the binding further comprise a locking device movable between a position in which it holds the base plate in position against the seating, and a position in which it no longer holds the base plate against the seating.

BRIEF DESCRIPTION OF THE DRAWINGS

The invention will be better understood by referring to the description below and to the attached drawings which form an integral part of it.

DESCRIPTION OF THE PREFERRED EMBODIMENT

Figure 1:
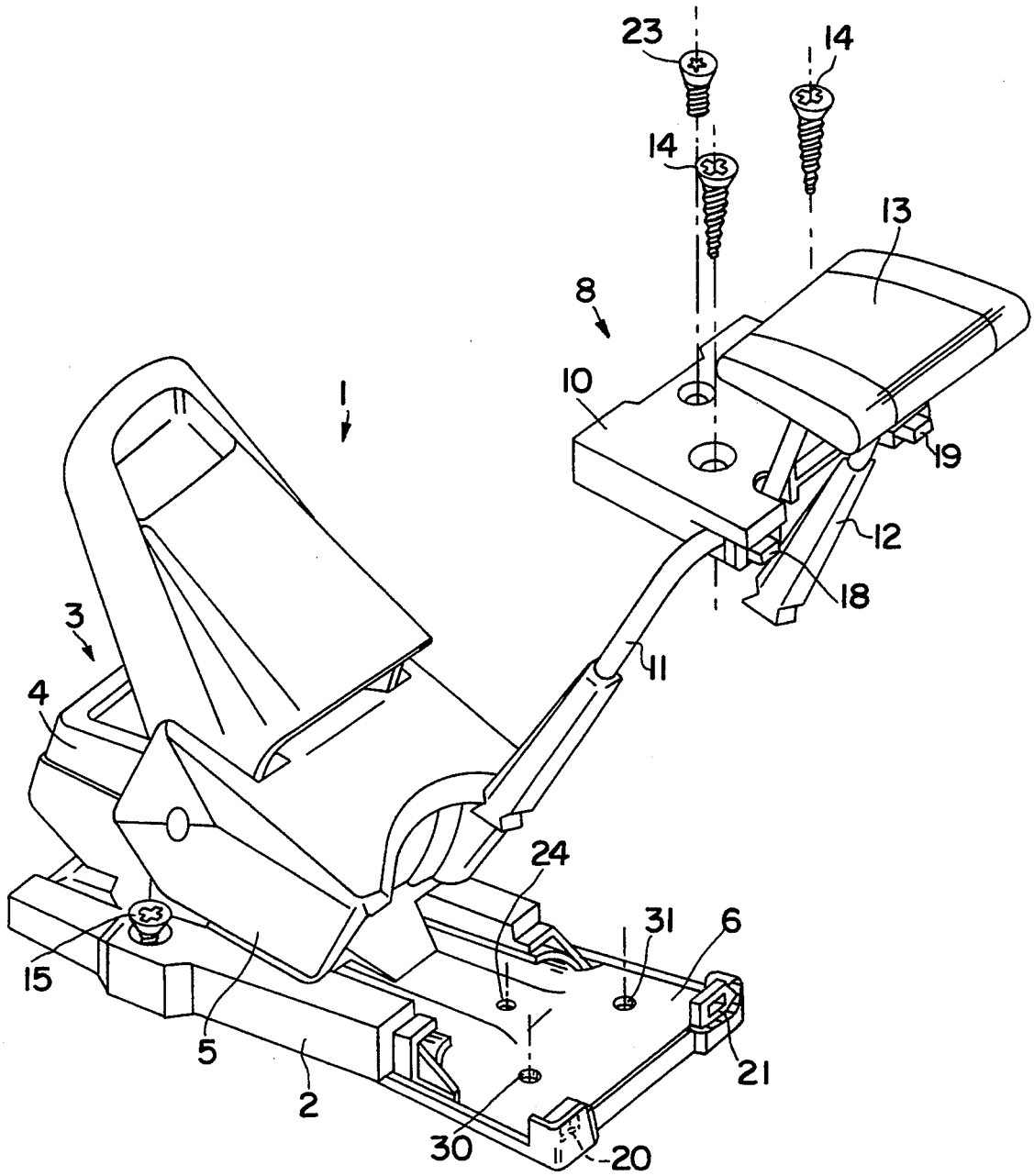
FIG. 1 is an overall perspective view of an alpine ski binding incorporating a boot position-retention element and a brake, according to an embodiment of the invention.

The binding 1 illustrated in FIG. 1 incorporates a generally elongated base plate 2, to which a position-retention element 3 for a ski boot is assembled.

FIG. 1 shows that the position-retention element is designed to hold the rear end of a boot and that is comprises a body 4 and a position-retention jaw 5 carried by the body. In conventional fashion, the body 4 extends over a portion of the length of the base plate 2, and can slide along the base plate 2, either in order to adjust its position to the length of the boot or during skiing following ski flection.

The base plate 2 is extended forward beyond the body 4 by a platform 6 designed to accept a brake 8. The brake 8 has a seating 10 designed to be superposed on the platform 6.

In conventional fashion, the brake 8 further comprises at least one brake arm and, in the present instance, two arms 11 and 12 jointed to the base 10, which are actuated by means of a pedal 13 between an inactive, inactive position in which the brake arms are raised above the upper surface of the ski, and an active, working position in which the brake arms extend beneath the lower surface of the ski.

In conventional fashion, a mechanism elastically returns the brake arms to their active, braking position. In the present instance, this mechanism consists of the wire itself constituting the brake arms, which is twisted under stress when the brake is actuated in the inactive position.

The base plate 2 is equipped with means ensuring assembly of the binding to a ski. In the example shown, these means are illustrated as screws, two front screws 14 (to be described below), and two rear screws 15. The latter are positioned on the edges of the base plate 2 and pass completely through it. A recess is provided for each screw, so that the screw head rests on the base plate 2 when the screw is tightened in the ski.

The rear screws 15 are preferably prepositioned; that is, before mounting, position-retention means keep the screws 15 assembled to the base 2, preferably with the screw tip projecting beneath the base plate. These are conventional means and will not be described in detail.

On the side, the brake 8 incorporates means for assembling the brake seating 10 to the base plate 2. In the example shown, these means are constituted by short tongues 18 and 19 located in the front part of the seating 10 and directed forward; these tongues cooperate, as do tenons, with mortises 20 and 21 located in the front portion of the platform 6. The mortises 20 and 21 are in fact carried by two wings folded upward at 90° in the front part of the platform.

The means of assembling the seating 10 to the base plate 2 further comprise a locking device which is movable between an active and an inactive position. In the active position, the locking device, in cooperation with the aforementioned tenons and mortises, provides for assembly of the seating 10 to the base plate 2. In the inactive position, the locking device permits the release of the seating 10 by means of a swinging motion, followed by movement of translation of the seating 10, in order to release the tenons 18 and 19 from the mortises 20 and 21.

In the example shown, the locking device is shown as a short screw 23 whose threaded part fits into a threaded hole 24 in the base plate 2 in the area of the platform 6. The length of the screw is such that the tip of the screw does not protrude beneath the base plate 2 when the seating 10 is assembled to the base plate 2 and the screw 23 is tightened.

In FIG. 1, in which the brake is shown separated from the base plate 2, the screws 14 allowing assembly of the binding to the ski are borne by the seating of the brake 8. The base plate 2 incorporates holes 30 and 31 through which pass the threaded portions of the screws 14. These holes 30 and 31 and those in the base 10 are superposed when the seating is in position above the base plate 2.

In other words, when the screws 14 are tightened in the ski, their heads rest on the seating 10 of the brake and exert indirect action on the base plate 2 by a clamping action transmitted by the seating 10.

In conventional fashion, the screws 14 and 15 used to assemble the binding to the ski are long enough to allow assembly of the binding to the ski under good holding conditions.

The heads of the screws 14 and of the screw 23 preferably have different, preferably incompatible, tool insert configurations. That is, different tools will be required to turn screws 14 and 23, respectively, and it will be impossible to turn all of the screws using the same tool. For example, the configuration in the heads of screws 14 is of the kind known by the naive "POZI-DRIV," and that of the screw 23, of the type incorporating six internal lobes and known as "TORX."

Figure 2:
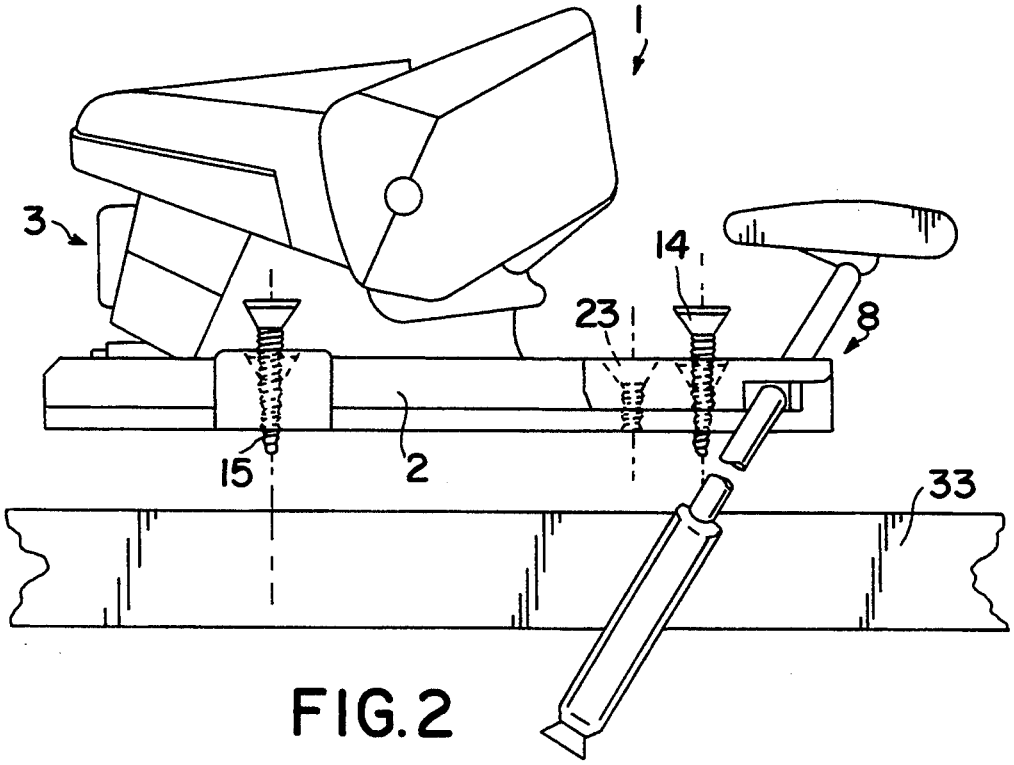
FIGS. 2 to 4 illustrate schematically the different operations involving mounting or dismantling the binding shown in FIG. 1.

From the preceding description, it emerges that the brake 8 can be assembled to the base plate 2 at the factory by screwing the screw 23 into the hole 24. In this position (illustrated in FIG. 2), all of the assembly screws 14 and 15 are prepositioned, i.e., ready to be screwed in, the screw tips preferably protruding slightly beneath the base plate 2. In this case, the bindings are delivered with the brake assembled to the base plate 2, thereby allowing them to the mounted very rapidly and simply on the ski 33.

Figure 3:
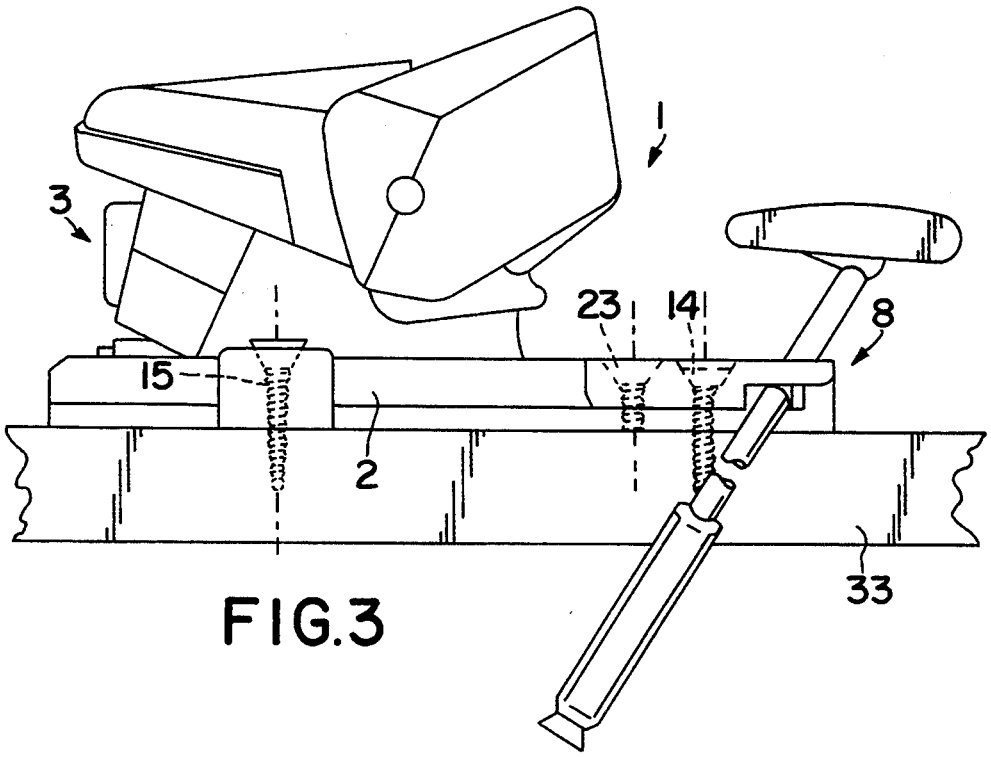

FIG. 3 illustrates the binding in the preceding figure assembled to a ski 33. In this position, the screws 14 and 15 are tightened in the ski. It will be noted that the front screws 14 act directly on the seating 10 of the brake 8 which, in turn, exerts a clamping action on the front part of the base plate 2. The brake is thus assembled to the ski using means for mounting its seating 10 on the base plate 2 and also using the screws 14. This element is thus very strong.

Figure 4:
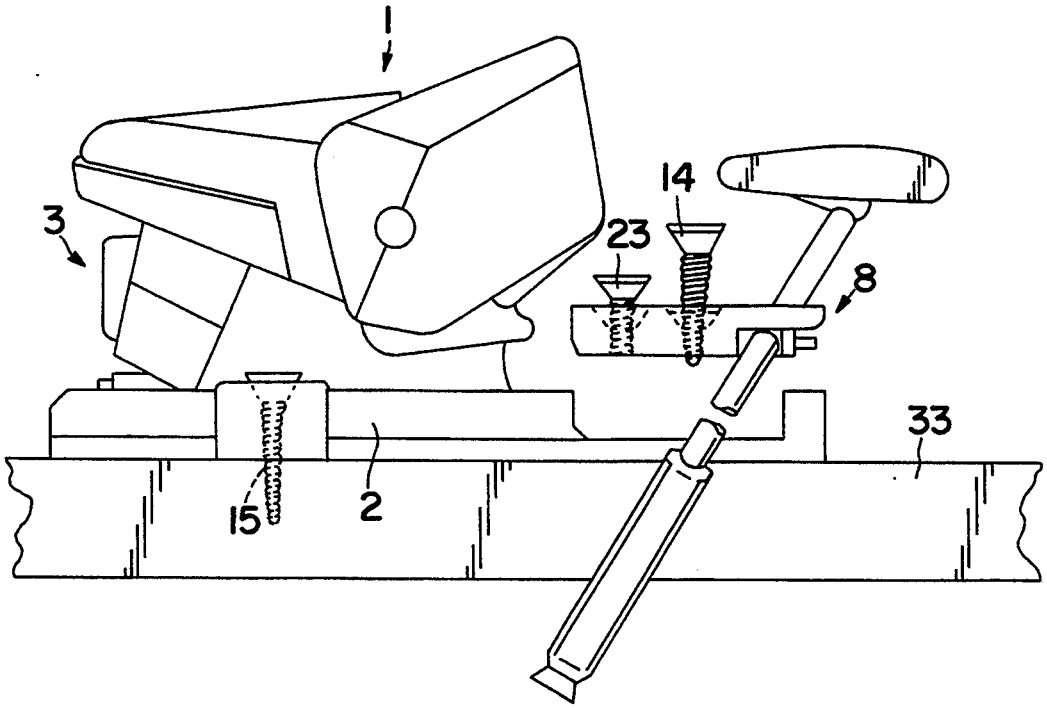

FIG. 4 illustrates the dismantling of the brake 8, for example, for replacement purposes. As shown schematically in this figure, the dismantling of the brake 8 requires that the front screws 14 and the locking screw 23 be loosened. The brake can then be pulled out of the base plate 2. A new brake can be put in place and assembled to the base plate 2 and to the ski by tightening the front screws 14 and the screw 23, which acts as a locking device.

Accordingly, the brake equipping the present binding can be dismantled simply, but from another perspective, it is already assembled to the remainder of the binding when the latter is first mounted on the ski. It can be observed that the brake seating occupies a sizable space on the base plate, and that the screw-mounting configuration adopted here ensures a high level of strength of the brake and the base plate on the binding on the ski, and, moreover, the opportunity to dismantle the brake.

It will be obvious that the invention is also applicable to a front binding to which a brake would be connected.

What is claimed is:

1. Alpine ski binding comprising a generally elongated base plate (2), to which a boot position-retention element (3) and a ski brake (8) are assembled, said base plate (2) being attached to a ski by screws (14, 15) which press it against an upper surface of said ski, said position-retention element (3) comprising a body (4) assembled to said base plate over at least one portion of a length of said body, and a boot position-retention device (5) carried by the body, said brake (8) comprising a seating (10) superposed on said base plate over a portion (6) of its length and assembled to said base plate by means including interlocking means located on front portions of said brake seating and said base plate and locking means (23) movable between a first position in which said locking means holds said base plate against said seating and a second position in which said locking means no longer holds said base plate against said seating, and at least one brake arm (11,12) connected to said seating (10) and movable in relation to said seating between an inactive rest position and an active operative position, said seating (10) of said brake and said base plate (2) of said binding incorporating superposed holes in order to receive at least part of the screws (14) used to attach said base plate to said ski, so that said screws tighten said base plate and said seating of said brake against said ski.

2. Binding according to claim 1, wherein said locking means (23) has a tool insert configuration different from that of said screws (14, 15) used to attach said base plate to the ski.

3. Binding according to claim 2, wherein said locking device (23) and said attachment screws (14, 15) have incompatible tool insert configurations.

4. Binding according to claim 2, wherein said locking device (23) is a short screw whose threaded portion fits into a hole (24) in said base plate.

5. Binding according to claim 1, wherein said interlocking means used to assemble said seating (10) of said brake to said base plate (2) incorporate, in a front part of said brake seating, tenons (18. 19) which cooperate with mortises (20, 21) in said base plate.

* * * * *

UNITED STATES PATENT AND TRADEMARK OFFICE

CERTIFICATE OF CORRECTION

PATENT NO. : 5,362,086

DATED : November 8, 1994

INVENTOR(S) : Baron et al

It is certified that error appears in the above-indentified patent and that said Letters Patent is hereby corrected as shown below:

On the title page, item [73] Assignee: change

"Salomon S.A., Courbevoie, France" to

--Salomon S.A., Annecy, France--.

Signed and Sealed this

Twenty-third Day of May, 1995

*Attest:*

*Attesting Officer*

BRUCE LEHMAN

*Commissioner of Patents and Trademarks*